US005945063A

United States Patent [19]

Aramaki

[11] Patent Number: 5,945,063

[45] Date of Patent: Aug. 31, 1999

[54] BOTTOM BLOWN GAS BLOWING APPARATUS FOR MOLTEN METAL LADLE

[75] Inventor: Keizo Aramaki, Mizunami, Japan

[73] Assignee: Tokyo Yogyo Kabushiki Kaisha, Japan

[21] Appl. No.: 09/028,782

[22] Filed: Feb. 24, 1998

[30] Foreign Application Priority Data

Feb. 25, 1997 [JP] Japan ..... 9-058434
Jun. 30, 1997 [JP] Japan ..... 9-187203

[51] Int. Cl.[6] ..... C21C 5/48

[52] U.S. Cl. ..... 266/220; 266/224; 266/265

[58] Field of Search ..... 266/217, 218, 266/220, 224, 265

[56] References Cited

U.S. PATENT DOCUMENTS 3,080,228 3/1963 Hale et al. ..... 266/217
3,291,596 12/1966 Verge et al. ..... 266/220
3,809,146 5/1974 Andrzajak et al. ..... 266/220

FOREIGN PATENT DOCUMENTS 64-15656 1/1989 Japan .

OTHER PUBLICATIONS

Japanese Abstract No. JP40210845A of Appl No. JP 63260917, Sakaguchi et al, Apr. 1990.

*Primary Examiner*—Scott Kastler
*Attorney, Agent, or Firm*—Thorp Reed & Armstrong, LLP

[57] ABSTRACT

The present invention relates to an apparatus for supplying bottom-blown gas through a porous plug in a ladle and for molten metal refining. A gas supply pipe 3 is connected to a bottom-blowing porous plug 2 attached at the bottom of a ladle 1. An accumulator tank 11*a*, is provided in parallel with the gas supply pipe 3. The bottom-blown gas is accumulated in the accumulator tank 11*a*, and blown into the ladle 1 to agitate the molten metal through the gas supply pipe 3 during refining. After the refining is finished, the switching valve 4 of the gas supply pipe 3 is closed, the switching valve 4*a* of the accumulator tank 11*a* is opened and the bottom blowing of a small amount of gas is supplied, and the blowing apparatus 10 is separated from the gas supply source 6 at joint 5. The bottom blowing of a small amount of gas for a long period of time prevents the molten metal from permeating into the ventilating pores of the bottom blowing porous plug after the refining, so that the solidification of molten metal in the ventilating pores of porous plug and the clogging of the pores can be avoided. Thereby, the repeated use of porous plug is made possible without the replacement of the porous plug.

5 Claims, 4 Drawing Sheets

BOTTOM BLOWN GAS BLOWING APPARATUS FOR MOLTEN METAL LADLE

BACKGROUND OF THE INVENTION

1. Field of the Invention

The present invention relates to an apparatus for supplying bottom-blown gas through a porous plug in ladle for molten metal refining.

2. Description of Related Art

In the process of refining molten metal, the molten metal subjected to primary refining in a refining furnace is transferred to a ladle, wherein a secondary refining is usually carried out. This is called ladle refining. A porous plug, which usually consists of a refractory, is provided at the bottom of the ladle. During refining, an inert gas such as argon or nitrogen gas is blown through this porous plug to agitate the molten metal.

FIG. 6 shows a porous plug and a supply pipe for inert gas disposed at the bottom of a conventional ladle. A porous plug 2 for bottom-blown gas is installed at the bottom of a ladle 1, and the tip end of the gas supply pipe is connected to the porous plug 2 via a cap 7.

The rear end of the gas supply pipe 3 is connected to or separated from a supply source 6 by a joint 5. When a switching valve 4 is opened and connected to the supply source, the bottom-blown gas is blown through the porous plug 2 to agitate the molten metal 8. After the refining is finished, the switching valve 4 is closed, by which the flow of gas (i.e., bottom blowing) is stopped, and the gas supply pipe 3 is separated from the gas supply source 6 at the joint 5, so that the ladle 1 is free to be moved.

After the ladle 1 filled with molten metal is moved to its destination the molten metal is discharged from the ladle for casting. The molten metal is discharged by opening a nozzle (not shown) provided at the bottom of the ladle to allow the molten metal to flow out for casting. The porous plug 2 has a porous construction such that a great number of ventilating pores are open. Just after the switching valve 4 is closed, the molten metal is prevented from permeating the ventilating pores by the pressure of gas remaining in the gas supply pipe 3. However, the gas pressure is soon decreased by the consumption of gas and decrease in temperature, so that the permeation of molten metal remaining in the ladle occurs.

The permeated molten metal cools and solidifies during the preparation for receiving the next charge, e.g., during the removal of slag etc. in the ladle performed after the transfer of molten metal. Once the metal is solidified, the ventilating pores are clogged. It is difficult to remove the solidified metal and gas blowing becomes impossible. Therefore, conventionally, the porous plug must be replaced for each charge.

To prevent the clogging, an apparatus has been proposed in which an accumulator tank is provided in the gas supply pipe to delay the decrease in gas pressure. For example, Unexamined Japanese Utility Model No. 64-15656 discloses a piping circuit for bottom-blown gas shown in FIG. 5. In this piping circuit, an accumulator tank 11 with a check valve 12 is connected in series with a gas supply pipe 3. Even after the gas supply pipe 3 is separated from the gas supply source 6, an amount of gas remains in the accumulator tank 11, so that a sudden decrease in gas pressure does not occur.

However, in the above piping circuit for bottom-blown gas in which the accumulator tank is connected in series with the gas supply pipe, the accumulated pressure does not exceed the pressure during blowing, and the capacity of the accumulator tank is not so large. Therefore, the permeation of molten metal into pores of the porous plug occurs even before the start of transfer of molten metal; this causes the ventilating pores to be clogged. This poses a problem in that the effect of the use of the accumulator tank is minimal; the porous plug can be reused two or three times only.

SUMMARY OF THE INVENTION

The present invention is made to solve the above problem, and accordingly an object thereof is to supply a small amount of bottom-blown gas from an accumulator tank continuously for a long period of time by arranging the accumulator tank in parallel with a gas supply pipe, thereby preventing the permeation of molten metal into the porous plug.

The means for achieving the above object comprises the following modes of invention. A first mode of the present invention provides a bottom-blown gas blowing apparatus for a molten metal ladle, comprising: a gas supply pipe, one end of which is connected to a ladle bottom blowing porous plug and the other end of which is connected to a gas supply source via a joint, the gas supply pipe has a switching valve at an intermediate position thereof; and an accumulator tank, one end of which is connected to the ladle bottom blowing porous plug and the other end of which is connected to the gas supply pipe on the gas supply side, the accumulator tank being arranged in parallel with the gas supply pipe and being provided with a check valve and switching valve.

The gas supply pipe is connected to the bottom blowing porous plug of ladle, the gas supply pipe is connected to the gas supply source by means of the joint, and the switching valve of the gas supply pipe is opened, by which a bottom-blown gas for agitation is blown into the ladle through the porous plug during refining. After the refining is finished, the switching valve of the gas supply pipe is closed, and the gas supply pipe is separated from the gas supply source by removing the joint to make the ladle movable.

At this time, the switching valve of the accumulator tank, which is arranged in parallel with the gas supply pipe, is opened so that the accumulated gas is supplied to the porous plug. Since the accumulator tank is disposed in parallel with the gas supply pipe, the gas received from the gas supply source is compressed by, for example, a compressor as necessary, and a required quantity of gas is stored in the accumulator tank.

The pressure of the bottom-blown gas from the accumulator tank prevents the permeation of molten metal into the ventilating pores of the porous plug. The quantity of bottom-blown gas required for preventing the permeation of molten metal is far smaller than the quantity for agitation of molten metal, so that the amount the switching valve is of the accumulator tank needs to be opened is far smaller than the amount the switching valve of the gas supply pipe needs to be opened.

A second mode of the present invention provides a bottom-blown gas blowing apparatus for a molten metal ladle, wherein the accumulator tank is provided with a pressure regulating valve for supplying a gas to the ladle bottom blowing porous plug at a predetermined pressure.

When the accumulator tank has a fixed capacity, the gas pressure in the tank is initially high, and gradually decreases as the gas is supplied to the porous plug. Since the quantity of bottom-blown gas required for preventing the permeation of molten metal is far smaller than the quantity of bottom-blown gas for agitation, an excess of gas is supplied to the porous plug when the gas pressure in the tank is initially high. To avoid this, the accumulator tank is provided with the pressure regulating valve to supply gas of a constant pressure, and the opening amount of switching valve of the accumulator tank is made smaller than the opening amount of switching valve of the gas supply pipe.

During the movement of the ladle, it is necessary to supply gas at a constant pressure. When the molten metal begins to flow out, the pressure of molten metal to the porous plug decreases, so that subsequently, the permeation of molten metal into the porous plug can be prevented even if the gas pressure in the accumulator tank decreases. By supplying gas from the accumulator tank at a constant pressure, the opening amount of switching valve of the accumulator tank can further be decreased, so that the gas in the accumulator tank can be supplied to the porous plug effectively for a long period of time.

A third mode of the present invention provides a bottom-blown gas blowing apparatus for a molten metal ladle, wherein the accumulator tank is provided with a constant flow rate valve for supplying the gas to the ladle bottom blowing porous plug at a predetermined pressure.

If the valve 4*a* is a constant flow rate valve instead of a pressure regulating valve, the supply of an excess of gas to the porous plug is avoided when the gas pressure in the tank is initially high, so that the gas in the accumulator tank can be supplied to the porous plug effectively for a long period of time.

A fourth mode of the present invention provides a bottom-blown gas blowing apparatus for a molten metal ladle, wherein the gas is nitrogen gas or argon gas. Any gas that does not have a harmful effect on the molten metal may be used. Usually, for molten steel, nitrogen gas or argon gas is preferable because it is low in cost and does not have an adverse effect on the quality of steel.

A fifth mode of the present invention provides a bottom-blown gas blowing apparatus for a molten metal ladle, wherein the molten metal is molten steel or molten iron.

The above-mentioned bottom-blown gas blowing apparatus can be used for the secondary refining of all kinds of molten metal. However, the greatest effect can be achieved when the molten metal is molten steel or molten iron.

BRIEF DESCRIPTION OF THE DRAWINGS

FIG. 2(*a*) is a longitudinal sectional view of a ladle bottom-blown gas blowing apparatus, and FIG. 2(*b*) is a graph showing the changes in pressure in a gas supply pipe, pressure in an accumulator tank, and static pressure of molten metal;

FIG. 4(*a*) shows a spring type, and FIG. 4(*b*) shows a gravity type;

DETAILED DESCRIPTION OF THE PREFERRED EMBODIMENTS

Figure 1:
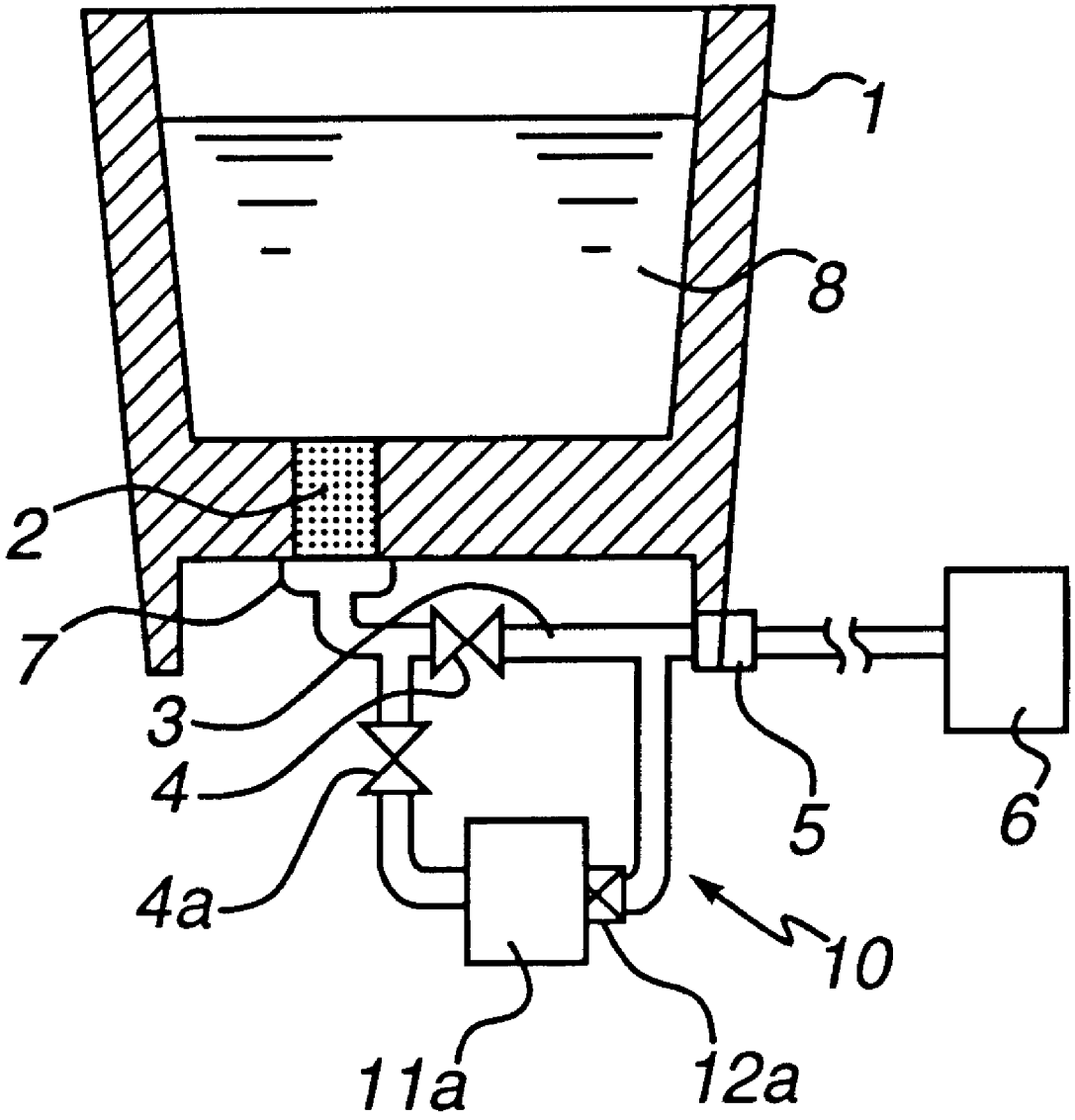
FIG. 1 is a longitudinal sectional view of a ladle provided with a ladle bottom-blown gas blowing apparatus in accordance with the present invention.

FIG. 1 shows a ladle bottom-blown gas blowing apparatus in accordance with the present invention. A gas supply pipe 3 is connected to a bottom-blowing porous plug attached at the bottom of a ladle 1 via a switching valve 4 and a cap 7. An accumulator tank 11*a*, which is provided in parallel with the gas supply pipe 3, constitutes a blowing apparatus 10. The blowing apparatus 10 is connected to a gas supply source 6 via a joint 5 to receive the supply of gas.

The gas supply pipe 3 has a switching valve 4. When the blowing apparatus 10 is connected to the gas supply source 6, the switching valve 4 is opened, and when the blowing apparatus 10 is disconnected from the gas supply source 6, the switching valve 4 is closed. The accumulator tank 11*a* has a check valve 12*a* on the gas inlet side thereof and a switching valve 4*a* on the outlet side. When the blowing apparatus 10 is connected to the gas supply source 6, the switching valve 4*a* is opened, and when the blowing apparatus 10 is disconnected from the gas supply source 6, the switching valve 4*a* is closed.

Figure 2A:
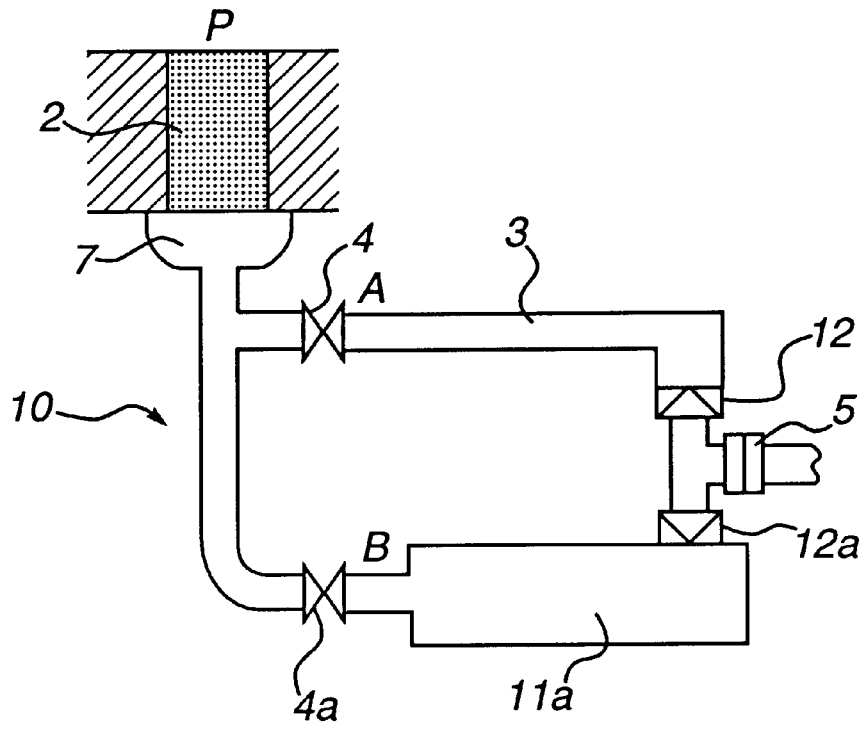
FIG. 2 is a view for illustrating the principle of the present invention.
Figure 2B:
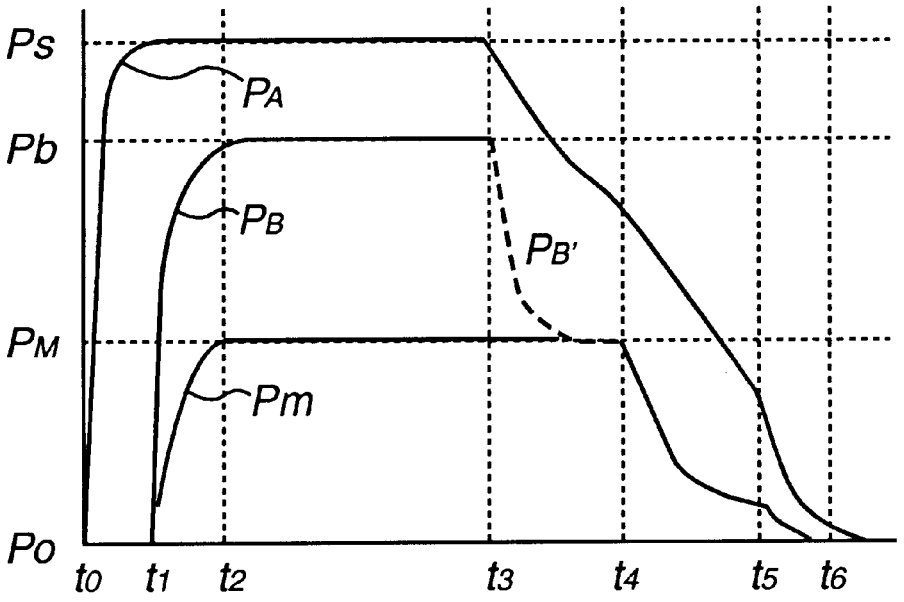

If a check valve 12 is provided on the inlet side of the gas supply pipe 3 so as to be close to the joint 5, air can be prevented from entering the gas supply pipe 3 when the gas supply source 6 is removed. FIG. 2(*a*) shows an alternative embodiment of the portion of the blowing apparatus of the present invention at which the pressure poses a problem. In this figure, reference character B denotes an outlet of the accumulator tank 11*a*, A denotes an outlet of the gas supply pipe 3, and P denotes an outlet side of porous plug 2.

FIG. 2(*b*) shows the changes in the pressure $P_A$ of the gas supply pipe 3 at point A, the pressure $P_B$ of the accumulator tank 11*a* at point B, and the static pressure $P_m$ of molten metal applied to point P. The abscissa represents time. At time to when the pressure accumulation of the accumulator tank is started, the blowing apparatus 10 is connected to the gas supply source, but the ladle is still empty, and the switching valve 4 of the gas supply pipe 3 and the switching valve 4*a* of the accumulator tank 11*a* are closed.

At time $t_1$, molten metal begins to be poured into the ladle, and at the same time, the switching valve 4 is opened. Before this time, the pressure accumulation of the accumulator tank 11*a* is finished, and the pressure $P_A$ reaches the original pressure $P_S$. The pressure $P_A$ remains at the original pressure $P_S$ until refining is finished and the switching valve 4*a* is opened. The pressure $P_m$ increases as the depth of molten metal increases, and reaches the pressure $P_M$ corresponding to when the molten metal reaches its maximum depth and when the pouring of molten metal is finished. The pressure $P_b$ increases above the pressure $P_m$ and approaches the pressure $P_b$ when the pouring of molten metal is finished, so that the molten metal is agitated.

During time $t_2$ to $t_3$, when the gas is being blown for refining, the depth of molten metal is unchanged, so that the pressures $P_A$ and $P_m$ are constant. The difference between $P_A$ and $P_b$, that is, the difference between $P_S$ and $P_b$, is decreased during this time caused by a flow resistance from the gas supply source to the gas supply pipe 3. The pressure $P_b$ is considerably higher than $P_M$, and this difference determines the intensity of agitation.

At time $t_3$, the refining is finished, and the blowing apparatus 10 is separated from the gas supply source 6 by means of the joint 5 to move the ladle. At this time, according to the present invention, the switching valve 4 is closed and the switching valve 4*a* is opened. Therefore, although the pressure $P_B$ subsequently remains at $P_b$, the pressure $P_a$ begins to decrease because the supply of bottom-blown gas from the accumulator tank 11*a* begins.

During time $t_3$ to $t_4$, when the ladle is moved, although the pressure $P_m$ is unchanged, the pressure $P_A$ continues to decrease because a small amount of bottom-blown gas is continuously blown through the porous plug 2. If the pressure $P_a$ becomes lower than the pressure $P_m$ during this time, the permeation of molten metal cannot be prevented. However, unlike the refining time, it is necessary that only a very small amount of gas is bottom-blown in order to prevent the permeation of molten metal. For this reason, the amount that the switching valve 4*a* is opened is made far smaller than the amount that the switching valve 4 so that the pressure $P_B$ exceeds the pressure $P_m$.

During time $t_4$ to $t_5$, when the molten metal is flowing out of the ladle for casting, the pressure $P_m$ decreases because the depth of molten metal decreases gradually. Although the pressure $P_B$ also continues to decrease, the permeation of molten metal is prevented because the pressure $P_B$ exceeds the pressure $P_m$. At time $t_5$, the outflow of molten metal is finished, slag floating above the molten metal is removed, and the ladle becomes empty at time $t_6$. Since the pressure $P_B$ exceeds the pressure $P_m$ until time $t_6$, the permeation of molten metal can be prevented completely.

Figure 5:
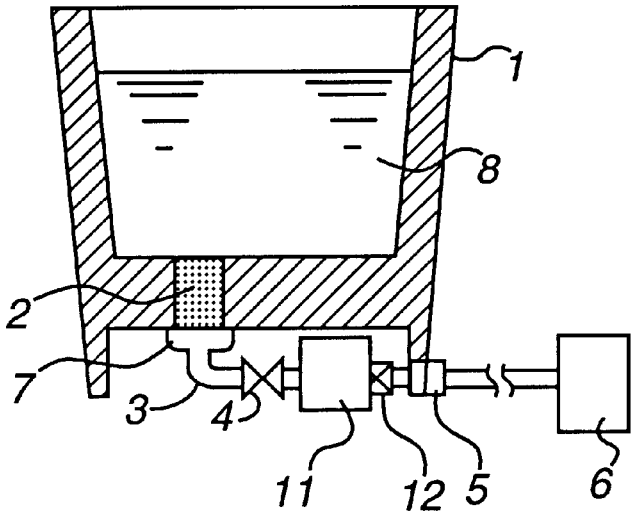
FIG. 5 (Prior Art)
FIG. 5 is a longitudinal sectional view of a ladle with a conventional ladle bottom-blown gas blowing apparatus.
Figure 6:
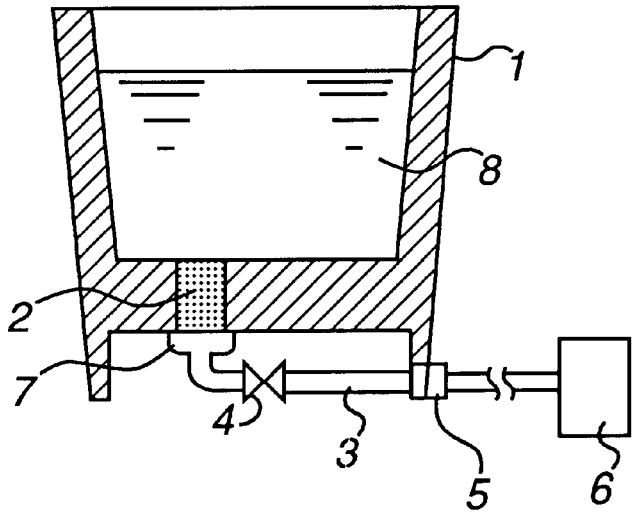
FIG. 6 (Prior Art)
FIG. 6 is a longitudinal sectional view of a ladle with a conventional bottom-blown gas supply pipe.

The above is a description of the principle of the present invention. Comparing the prior art as shown in FIG. 5 or 6 with the present invention, the conventional series connection of the accumulator with a gas supply pipe can be operated as follows. When the gas blowing finishes, the valve 4 is closed and the gas supply source 6 is detached from the joint 5.

When the gas supply source 6 is separated, the pressure $P_B$ of the gas supply pipe begins to decrease from $P_b$, and the pressure $P_b$ is lower than $P_A$. Moreover, since the quantity of the supplied gas is equal to the gas quantity in agitation, the pressure $P_B$ decreases suddenly. This sudden decrease is indicated by the broken line as a $P_B'$ curve in FIG. 2(*b*). As the pressure $P_B'$ decreases and approaches $P_M$, the bottom-blown gas quantity also decreases, so that the decrease is gradual, and the $P_B'$ curve takes a constant value.

However, this constant value is $P_M$, and the supply of bottom-blown gas is stopped at this time. Moreover, actually the temperature of molten metal decreases, though gradually, so that the pressure $P_B'$ sometimes becomes lower than $P_M$. At this time, the molten metal permeates into the ventilating pores of the porous plug 2, and is solidified subsequently to clog the pores.

Figure 3:
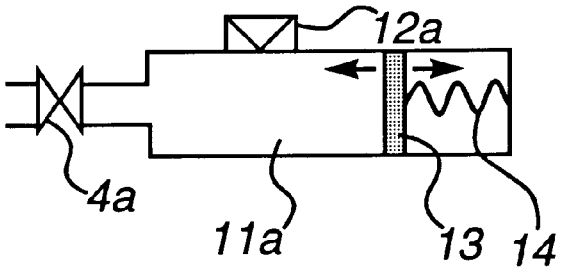
FIG. 3 is longitudinal sectional view of an accumulator tank with a pressure regulating valve.

In the present invention, if a pressure regulating valve is provided on the accumulator tank or a constant flow rate valve is provided on the outlet side of the accumulator tank, the accumulated gas can be used effectively, so that the pressure of the accumulator tank can be regulated. An example of constant pressure construction is shown in FIG. 3. A movable sluice valve 13, provided in the accumulator tank 11*a*, is pressed by a spring 14. When gas enters the accumulator tank 11*a* through the check valve 12*a*, with the switching valve 4*a* being closed, the sluice valve 13 compresses the spring 14, so that the accumulated gas capacity in the accumulator tank 11*a* is increased.

When the switching valve 4*a* is opened after the pressure accumulation to supply the bottom-blown gas from the accumulator tank 11*a*, the spring 14 pushes the sluice valve 13 in equilibrium with the accumulated pressure, so that the pressure in the tank is kept constant within the elastic limit of the spring. In FIG. 2(*b*), at least during time $t_3$ to $t_4$, that is, during the time when the ladle is moved, it is preferable that the pressure of bottom-blown gas be constant.

If the elastic limit of the spring 14 is selected so that the pressure of the supplied gas is equal to the pressure of gas blown during time $t_3$ to $t_4$, the pressure $P_B$ does not decrease, and the quantity of bottom-blown gas becomes constant. If this gas pressure is equal to the minimum pressure for preventing molten metal from permeating into the ventilating pores of the porous plug by adjusting the amount that the switching valve 4*a* is opened, excessive bottom blowing is avoided, so that the pressure in the accumulator tank can be decreased.

Figure 4A:
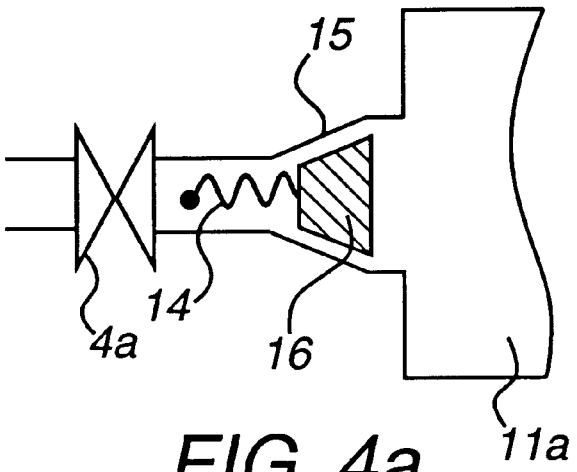
FIG. 4 are longitudinal sectional views of constant flow rate valves.
Figure 4B:
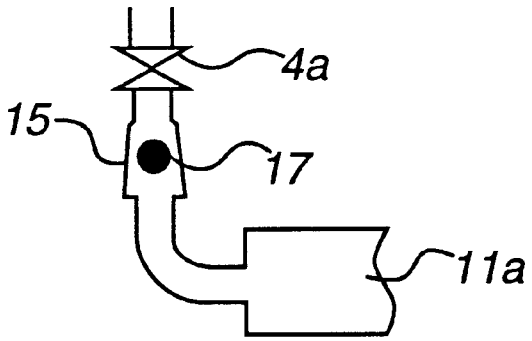

In place of the accumulator tank of a constant pressure construction, a constant flow rate valve provided on the outlet side of the accumulator tank also achieves the same effect. The construction of the constant flow rate valve is shown in FIG. 4. FIG. 4(*a*) shows a spring type constant flow pipe, which contains a truncated cone shaped valve 16 in a tapered pipe 15, pushing against the flow by means of a spring 14. When the gas pressure in the accumulator tank 11*a* is high, the pressure of the flowing gas increases, so that the valve 16 compresses the spring 14, whereby the gap between the tapered pipe 15 and the valve 16 is decreased.

When the gas pressure in the accumulator tank 11*a* decreases, the pressure of the flowing gas decreases, so that the force with which the valve 16 compresses the spring 14 decreases, and the gap between the tapered pipe 15 and the valve 16 is increased. That is to say, the flow resistance in the constant flow rate valve changes in inverse proportion to the pressure, so that a constant gas flow rate can be obtained.

FIG. 4(*b*) shows a constant flow rate valve of a type such that gravity is used in place of the spring. A spherical float 17 is contained in a tapered pipe 15, and the tapered pipe 15 is positioned vertically. When the pressure of the flowing gas is high, the float 17 floats to decrease the gap between the tapered pipe 15 and the float 17, by which the flow resistance in the constant flow rate valve is increased. On the other hand, when the pressure of the flowing gas is low, the float 17 sinks to increase the gap between the tapered pipe 15 and the float 17, by which the flow resistance in the constant flow pipe is decreased. Therefore, the gas flow rate is always kept constant.

Besides these types of valves, a constant gas flow rate may be obtained using, for example, a constant flow rate device for controlling the amount the switching valve 4*a* is opened by measuring the flow velocity of gas. However, the ladle is subject to a high temperature, and also subject to strong vibrations when the molten metal is poured or allowed to flow out. The above-mentioned accumulator tank and constant flow rate valve are simple in construction, withstand vibrations, and can use a heat resisting material, so that they are suitable for the use in a harsh environment.

The following is a description of a working example of the apparatus.

As shown in FIG. 1, the ladle bottom-blown gas blowing apparatus in accordance with the present invention was installed adjacent to the porous plug 2 at the bottom of the ladle 1 via the cap 7, and reuse of the porous plug 2 was investigated during a one month investigation. The porous plug, measuring 80 mm in diameter and 300 mm in length, was made of porous high alumina refractory brick formed with many through holes. The accumulator tank 11*a* had a capacity of 70 L (liter), and was provided with a spring type constant flow rate valve on the outlet side.

The molten metal was molten steel, the depth of which in the ladle was about 2 m, and the static pressure of which was about 1.5 kgf/cm$^2$. On the other hand, the pressure of the gas supply source was 8 kgf/cm$^2$, the bottom-blown gas flow rate after the completion of refining was about 0.5 L/min, and the time taken from when refining was completed to when the ladle becomes empty, that is, the time $t_3$ to $t_6$ indicated in FIG. 2(*b*) was 60 to 120 minutes.

As the result of this investigation, in the case where the ladle bottom-blown gas blowing apparatus in accordance with the present invention was used, the porous plug could be used repeatedly 5 to 7 times. On the other hand, with the conventional blowing apparatus, in which the accumulator tank was arranged in series with the supply pipe, the number of reuse times was 3 or less.

In the above embodiment of the present invention, a compressor can be provided with the accumulator tank to enhance the accumulated pressure when the pressure of the supply gas is not high enough. Also, a solenoid valve or magnetic valve can be used for the switching valves 4 and 4*a*. The closing of the switching valve 4 and the opening of the switching valve 4*a*, and vice versa, can be performed with an automatic electrical regulator.

Next, the effect of the present invention will be described. As described above, according to the present invention, the accumulator tank is arranged in parallel with the supply pipe for ladle bottom-blown gas, by which during the refining, the supply pipe is connected to the gas supply source to supply the bottom-blown gas, but after the refining is completed, the bottom-blown gas is supplied from the fully accumulated tank. Because the accumulated pressure can be increased to a necessary pressure, the amount that the switching valve is opened for the accumulator tank can be decreased. Therefore, a small amount of gas can be bottom-blown continuously for a long period of time until the molten metal and slug in the ladle are allowed to flow out so that the ladle becomes empty after the refining.

The bottom blowing of a small amount of gas for a long period of time prevents the molten metal from permeating into the ventilating pores of the bottom blowing porous plug after the refining, so that the solidification of molten metal in the ventilating pores of the porous plug and the clogging of the pores can be avoided. Thereby, the repeated use of porous plug is made possible without the replacement of the porous plug.

Further, the accumulator tank can have a constant pressure construction, or be provided with the constant flow pipe on the outlet side, by which the bottom blowing of an excessive amount of gas can be prevented. Thus, the present invention achieves great effect by prolonging the life of porous plug, and the time taken for the replacement of porous plug is decreased significantly, thereby the rate of operation of ladle can be enhanced.

I claim:

1. A bottom-blown gas blowing apparatus for a molten metal ladle comprising:

(a) a gas supply pipe, one end of which is connected to a porous plug located at the bottom of a ladle, and the other end of which is connected to a gas supply source via a joint, said gas supply pipe having a switching valve at an intermediate position thereof; and (b) an accumulator tank having a gas inlet side and a gas outlet side, said gas outlet side being connected to said porous plug and said gas inlet side being connected to said gas supply pipe between said switching valve and said joint, said accumulator tank being arranged in parallel with said gas supply pipe and being provided with a check valve on said gas inlet side and a second switching valve on said gas outlet side.

2. A bottom-blown gas blowing apparatus for a molten metal ladle according to claim 1, wherein said accumulator tank is further provided with a pressure regulating valve for supplying a gas to said ladle bottom blowing porous plug at a constant pressure.

3. A bottom-blown gas blowing apparatus for a molten metal ladle according to claim 1, wherein said accumulator tank is provided with a constant flow rate valve for supplying a gas to said ladle bottom blowing porous plug at a constant flow rate.

4. A bottom-blown gas blowing apparatus for a molten metal ladle comprising:

(a) a gas supply pipe, one end of which is connected to a porous plug located at the bottom of a ladle, and the other end of which is connected to a gas supply source via a joint, said gas supply pipe having a switching valve at an intermediate position thereof, wherein said gas supply source is capable of supplying a gas selected from the group consisting of nitrogen and argon; and (b) an accumulator tank having a gas inlet side and a gas outlet side, said gas outlet side being connected to said porous plug and said gas inlet side being connected to said gas supply pipe between said switching valve and said joint, said accumulator tank being arranged in parallel with said gas supply pipe and being provided with a check valve on said gas inlet side and a second switching valve on said gas outlet side.

5. A bottom-blown gas blowing apparatus for a molten metal ladle comprising:

(a) a gas supply pipe, one end of which is connected to a porous plug located at the bottom of a ladle, and the other end of which is connected to a gas supply source via a joint, said gas supply pipe having a switching valve at an intermediate position thereof, wherein said ladle is capable of containing a molten metal selected from the group consisting of molten steel and molten iron; and (b) an accumulator tank having a gas inlet side and a gas outlet side, said gas outlet side being connected to said porous plug and said gas inlet side being connected to said gas supply pipe between said switching valve and said joint, said accumulator tank being arranged in parallel with said gas supply pipe and being provided with a check valve on said gas inlet side and a second switching valve on said gas outlet side.

* * * * *